US006132319A

United States Patent [19]

Schluter

[11] Patent Number: 6,132,319

[45] Date of Patent: Oct. 17, 2000

[54] BILLIARD TRAINING DEVICE

[76] Inventor: Robert L. Schluter, 33 Roberts Rd., Mineral Wells, Tex. 76067

[21] Appl. No.: 09/361,193

[22] Filed: Jul. 26, 1999

[51] Int. Cl.[7] ..... A63D 15/00

[52] U.S. Cl. ..... 473/2; 434/247; 200/4; 473/19; 473/42; 73/12.02

[58] Field of Search ..... 473/FOR 1, FOR 2, 473/FOR 5, FOR 17, FOR 19, FOR 42; 434/247, FOR 247; 73/12, 2; 200/4, 64, 61.1, FOR 4, FOR 64, FOR 61.1

[56] References Cited

U.S. PATENT DOCUMENTS

| | | | |
|---|---|---|---|
| 2,708,577 | 5/1955 | Bunka | 273/2 |
| 3,724,849 | 4/1973 | Pierce | 273/2 |
| 3,894,739 | 7/1975 | Goldstein | 273/186 R |
| 5,042,814 | 8/1991 | Bennett | 273/183 A |
| 5,597,360 | 1/1997 | Freedenberg | 473/2 |

*Primary Examiner*—Mark S. Graham
*Assistant Examiner*—Mitra Aryanpour
*Attorney, Agent, or Firm*—Charles D. Gunter, Jr.

[57] ABSTRACT

A billiards training apparatus is described, the apparatus used in training a user to properly strike a cue ball. The apparatus comprises a housing having a front face, the housing coupled to a striking platform extending a length from the housing. An elongated striker is held in position by at least one support element, the elongated striker having a striking end and a terminal end. Further, the striking end extends out from the front face of the housing and is positioned parallel to the striking platform. At least one lateral movement sensing element is electronically coupled to at least one visual indicia element, the elements being lights in one embodiment of the invention. The elongated striker is positioned to be struck in-line by a cue, the lateral movement sensing element alerting the user to any non-linear movement of the cue relative to the striker.

22 Claims, 9 Drawing Sheets

BILLIARD TRAINING DEVICE

BACKGROUND OF THE INVENTION

1. Field of the Invention

The present invention relates in general to a device to train a user to hit billiard balls properly. More specifically, the present invention relates to an apparatus that trains the user to properly hit a cue ball in-line and with adequate force, the user being alerted instantaneously to any non-linear movement of the cue.

2. Description of the Prior Art

The game of billiards has its roots in 15th Century Northern Europe, being played originally using only two or three balls and a "mace", a stick which pushed the balls around on a flat table. The use of the "cue" stick become prevalent in the 1600's. The cue stick is distinguishing in being used to hit or strike at the balls instead of merely pushing them. Today, most billiard games involve many balls, and in particular, the use of one "cue ball" which is initially hit to break apart a formation of the other balls and to hit the other balls individually. Thus, proper striking of the cue ball with the cue stick is crucial for optimal performance.

As practicing on actual billiard and cue balls can become tedious, there has been interest in the development of a training apparatus that would help the user develop his skills. Bunka (U.S. Pat. No. 2,708,577) is an example of a cue practicing machine that mechanically moves an attached cue back-and-forth while the user holds the cue, allowing the user to get the "general feel" of how to hit the cue ball. There are other devices old in the art that are used as simple physical guides for the cue to help align a cue on the billiard table. However, there are no devices to date that allow the user to freely hit a target and acquire immediate feedback. Short of having direct guidance from a billiards expert, hitting the cue ball takes much trial and error striking of the cue ball while playing.

What is needed is an apparatus for training the potential billiards player that can teach the user proper form in hitting a cue ball. While there have been some training devices that help users hit a golf ball, the device being designed for use with a golf club, they are very distinct from a device that would be used for a cue, where the striking end is very small compared to a large golf club. Further, the mechanics of hitting a golf ball and cue ball are quite distinct from one another, thus making a device for one unusable for training for the other. Thus, the present invention is directed towards and uniquely designed for billiards training.

SUMMARY OF THE INVENTION

One object of the present invention is to provide an apparatus that will allow a potential billiards player to practice hitting a cue ball alone.

Another object of the present invention is to provide a training apparatus for striking a cue ball that will give the user instant feedback.

The objects are achieved in an apparatus comprising a housing having a front face, the housing coupled to a striking platform extending a length from the housing. An elongated striker is held in position by at least one support element, the elongated striker having a striking end and a terminal end. Further, the striking end extends out from the front face of the housing and is positioned parallel to the striking platform. At least one lateral movement sensing element is electronically coupled to at least one visual indicia element, the elements being lights in one embodiments of the invention. The elongated striker is positioned to be struck in-line by a cue, the lateral movement sensing element alerting the user to any non-linear movement of the cue relative to the striker.

The elongated striker is held within at least one support element within the housing. A biasing spring maintains a positive pressure on the striker as it is being struck by a user. There can be two, four, or other number of lateral movement sensing elements, each of which can have an adjustable sensitivity. The housing can be mounted on a wall and folded down to a vertical position when not in use, and a horizontal position for training.

Additional objects, features and advantages will be apparent in the written description which follows.

DETAILED DESCRIPTION OF THE INVENTION

General Description

The cue striking apparatus is described with reference to FIGS. 1–12. A general description of the invention is made with reference to FIGS. 1–4. A more detailed description of the invention is made with reference to FIGS. 5–9. Finally, a description of the use of the apparatus is made with reference to FIGS. 10–12.

Figure 1:
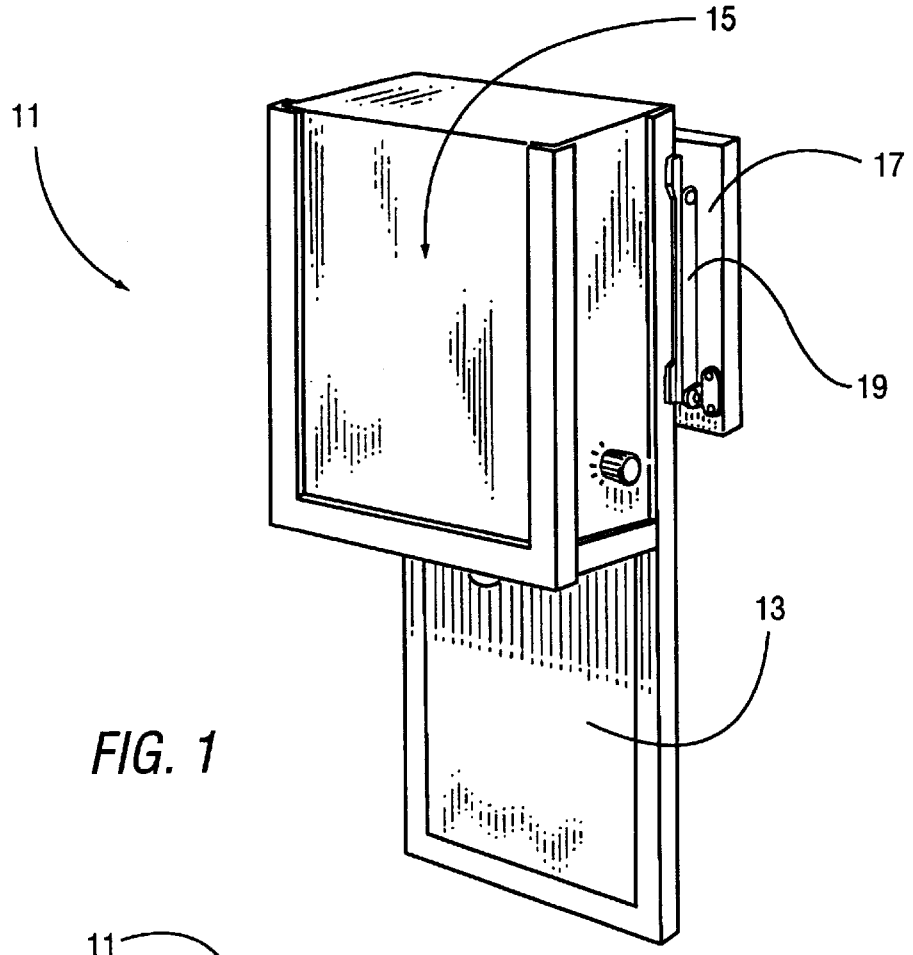
FIG. 1 is a perspective view of the apparatus of the invention in the vertical position.
Figure 2:
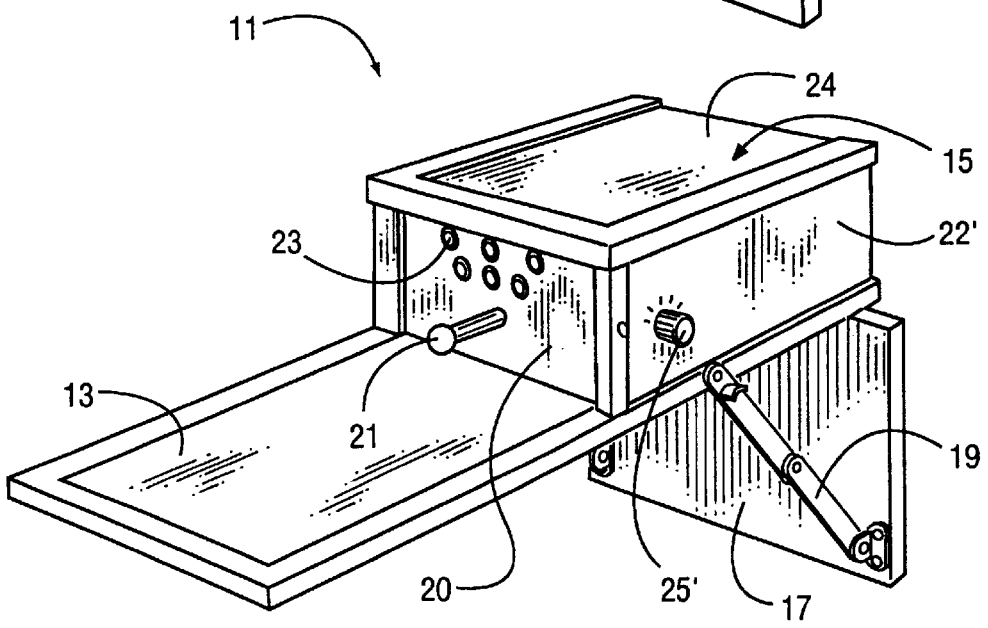
FIG. 2 is a perspective view of the apparatus of the invention in the horizontal position.

The apparatus 11 is shown in a wall-mounted position in FIG. 1. The housing 15 is coupled to a striker platform 13, and the platform 13 is attached to the wall plate 17 through hinge element 19. The hinge element allows the apparatus 11 to be placed in either the vertical position as in FIG. 1, or the horizontal position as in FIG. 2. Referring now to FIG. 2, the front face 20, side 22' (only one of which is shown), and top 24 are shown. Extending from the front face 20 is the elongated striker 21, the striker 21 extending parallel to the striking platform 13. Right sensor adjustment 25' extends from side 22', the function of which is described in more detail infra. Further, visual indicia 23 is located on front face 20, there being several indicia in the present embodiment of the invention. It is to be understood that the sensor elements can take many forms other than direct metal-to-metal switching contacts. Other forms of sensors would include light-sensitive elements, magnetic sensors, semiconductor-based elements, and other sensors capable of detecting a non-linear movement of the elongated striker. Further, the indicia can take many forms such as diodes or CRT outputs, and can include sound or other means of alerting the user who is training on the apparatus.

Figure 3:
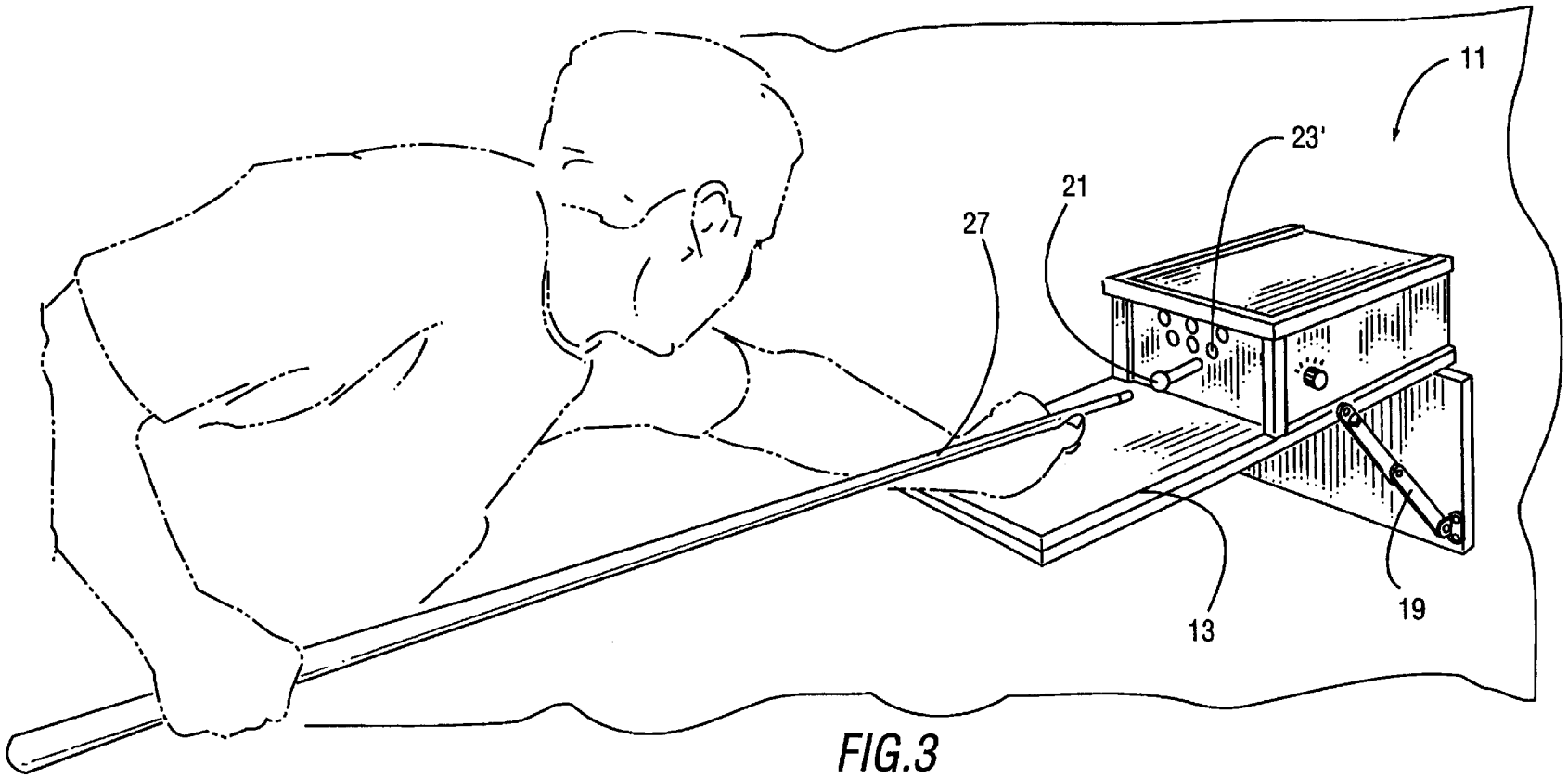
FIG. 3 is a perspective view of a user training on the apparatus.

FIG. 3 shows the apparatus 11 in the horizontal position with a user holding cue 27 against the striking platform. The end of the cue 27 is aimed by the user at the elongated striker 21. The visual indicia 23', in this embodiment a light, alerts the user to any non-linear movement of the cue 27 relative to the elongated striker 21. Ideally, the cue 27 should strike the elongated striker 21 in-line in such a way that there is no movement to the right, left, up, or down. Any of these non-linear movements will cause one of the visual indicia to alert the user to the movement.

Figure 4:
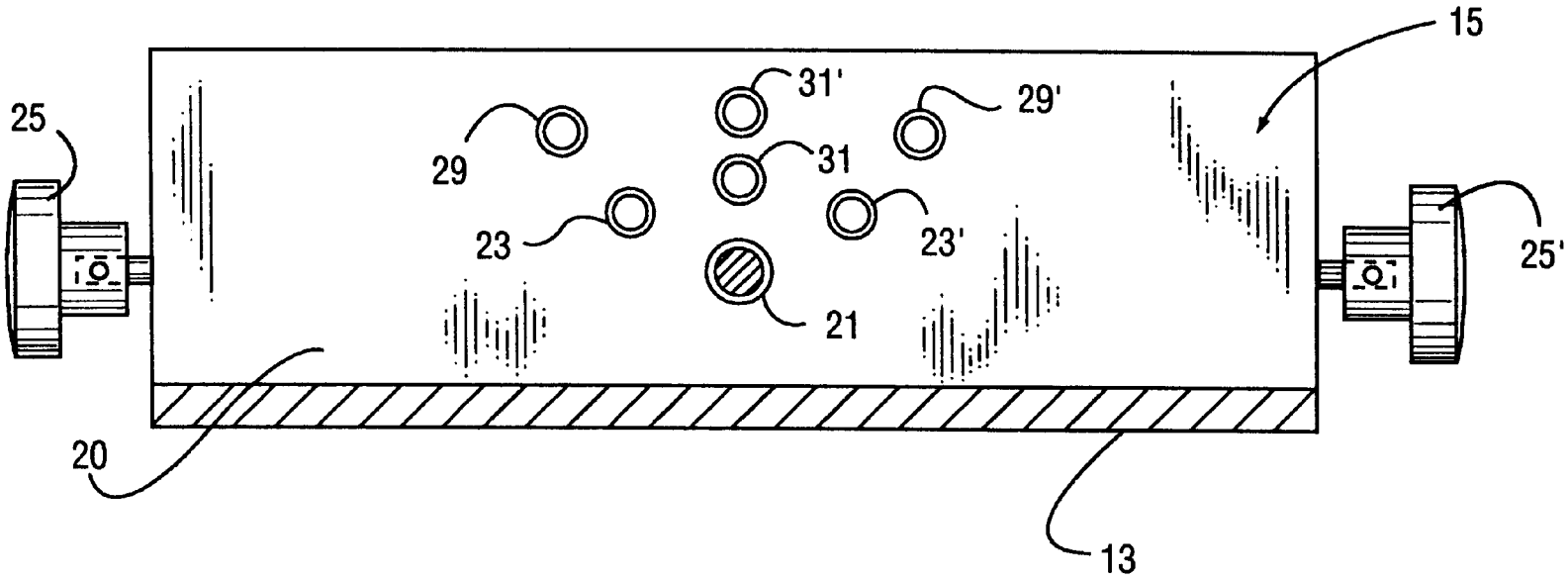
FIG. 4 is a front view of the apparatus.

The visual indicia of the present embodiment of apparatus 11 are described with reference to FIG. 4. In this embodiment, the visual indicia are lights which can be of different colors. Lights 23 and 23' alert the user to any non-linear movement of the elongated striker either to the left or right, respectively. Lights 31 and 31' alert the user to any non-linear movement of the striker 21 either up or down, respectively. Lights 29 and 29' alert the user to a strike that is of sufficient force.

Detailed Description

Figure 5:
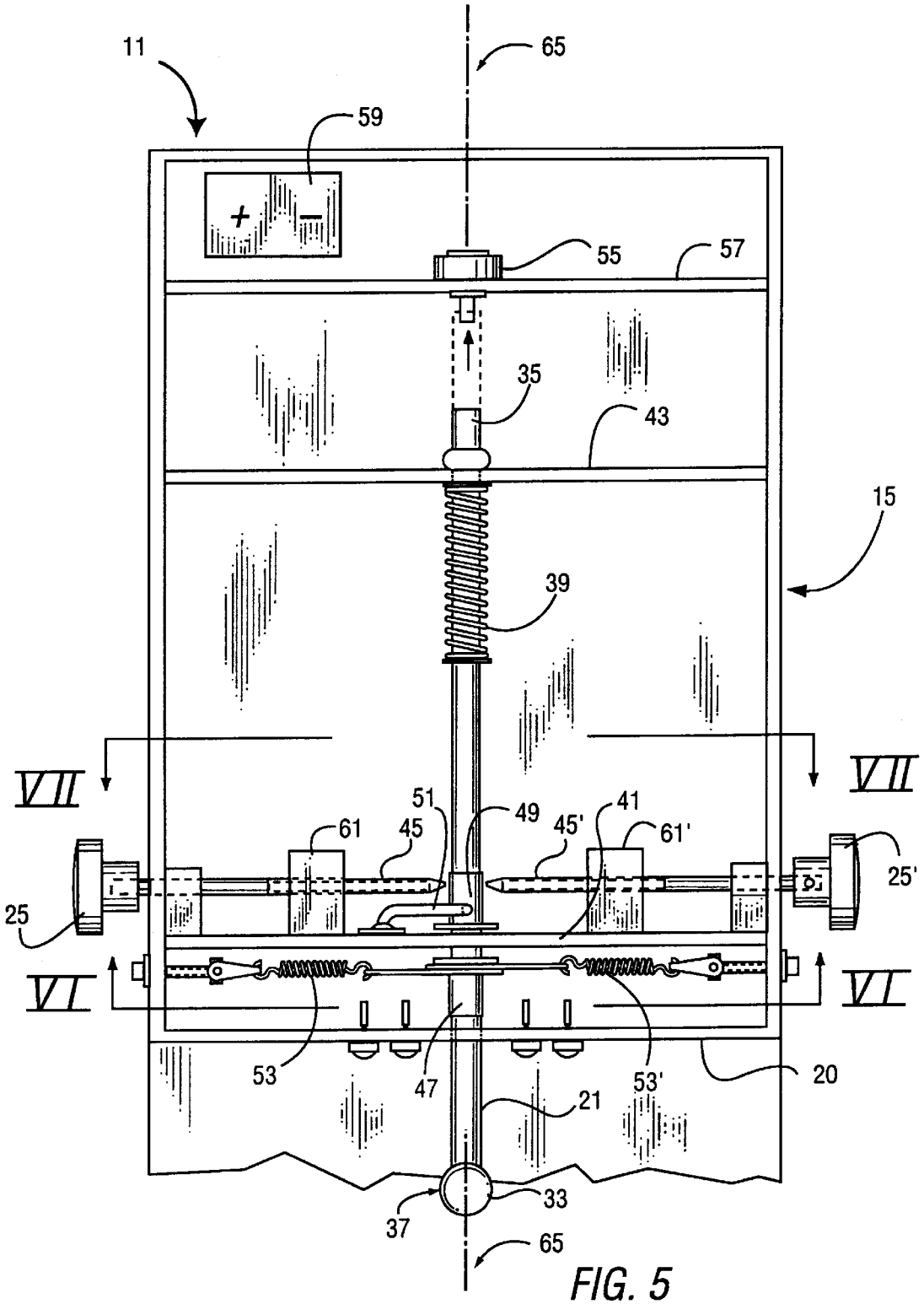
FIG. 5 is a view of the housing without the top.

The apparatus 11 is described in further detail with reference first to FIG. 5, wherein the top 24 has been removed to show the inside of the housing 15. The elongated striker 21 having striker end 33 and terminal end 35 is shown, the striker end in the present embodiment having a cue target 37. The elongated striker 21 is linear about an axis 65, the elongated striker moving in-line along the axis 65 when struck by a cue without any non-linear movement.

The elongated striker 21 is held in place to allow movement about the axis 65. At least one support element is used to hold the striker 21 in place. In the present embodiment, support elements 41 and 43 hold the elongated striker 21 in place, the striker being placed through holes in the support elements. A biasing spring 39 holds the elongated striker 21 within the support elements 41 and 43, the spring 39 maintaining a positive pressure upon the striker such that it is pushed towards the front face 20. Tension springs 53 and 53' place lateral tension upon the elongated striker, the force applied at 180° on either side of the striker 21. The springs are attached to ring mount 47, the ring mount allowing free movement of the elongated striker along its axis 65. The tension springs 53 and 53' can be adjusted to fine tune the lateral position in which the axis of the elongated striker 21 lies.

The present embodiment of apparatus 11 has 4 lateral movement sensing elements that are sensitive to any movement of the elongated striker 21 that is not along the axis 65, hence, non-linear movement. Placed at 180° phasing with respect to one another are lateral movement sensing elements 45 and 45', the elements being held in place by blocks 61 and 61', respectively. The elements are in electrical contact with a power source 59 such that, when the bushing 49 makes contact with the tip of either element 45 or 45', the electrical circuit is complete and a light on the front face will alert the user to the contact. Contact with either element 45 or 45' occurs when a cue causes a non-linear movement of the elongated striker 21, which is in turn caused by a non-linear strike by the cue 27. Further, there are two lateral movement sensor elements 51 and 51' (see FIGS. 7A–7C) that detect up or down movement in the same manner as elements 45 and 45'. The sensitivity of the lateral movement sensing elements 45 and 45' can be adjusted by turning the left or right sensor adjustments 25 or 25', respectively.

Push switch 55 is fixedly coupled to support element 57. The push switch 55 is engaged by the terminal end 35 of the elongated striker upon being stuck with an adequate force at the striking end 33 by the cue of the user. The push switch 55 is electronically coupled to a power source 59 such that when the switch 55 is engaged, a light on the front face 20 alerts the user to a strike of adequate force.

Figure 6:
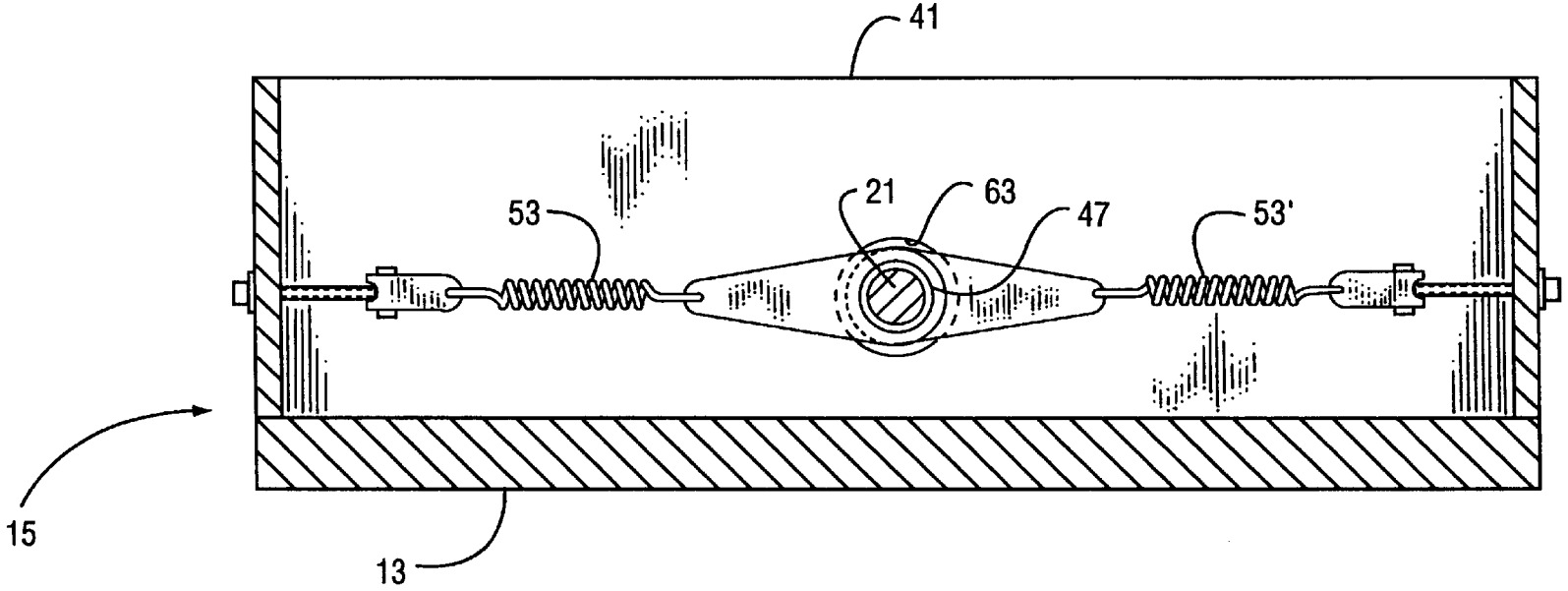
FIG. 6 is a cutaway view taken across a line VI—VI from FIG. 5.

The tension springs 53 and 53' are shown in greater detail in FIG. 6. The springs are attached to the inside walls of housing 15 at one end, and to ring mount 47 surrounding the elongated striker 21 at the other end. The elongated striker 21 extends through opening 63 to allow the striker 21 to move along its axis 65. Further, the ring 47 fits in such a manner as to allow the striker 21 to move freely along its axis. There is enough space within opening 63 to allow the striker 21 to move laterally if struck in a non-linear fashion, thus allowing the lateral movement sensing elements to contact the bushing 49 and alert the user to a non-linear strike.

Figure 7A:
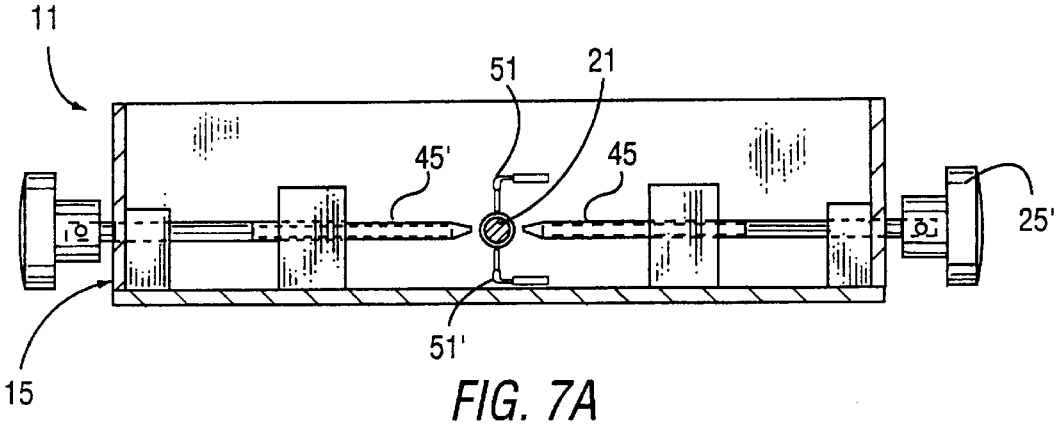
FIG. 7A is a cutaway view taken across a line VII—VII from FIG. 5.
Figure 7B:
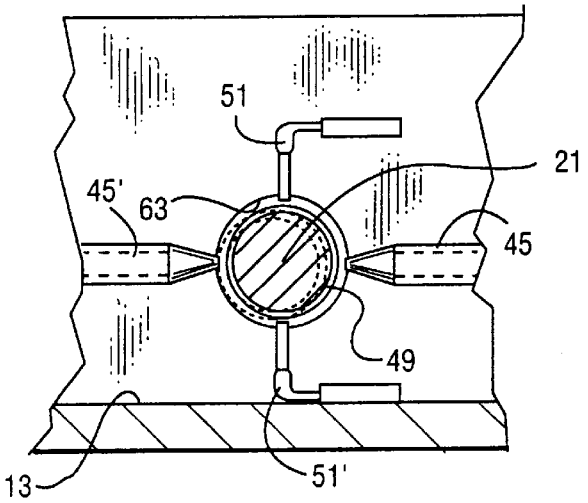
FIG. 7B is a closeup taken of FIG. 7A.
Figure 7C:
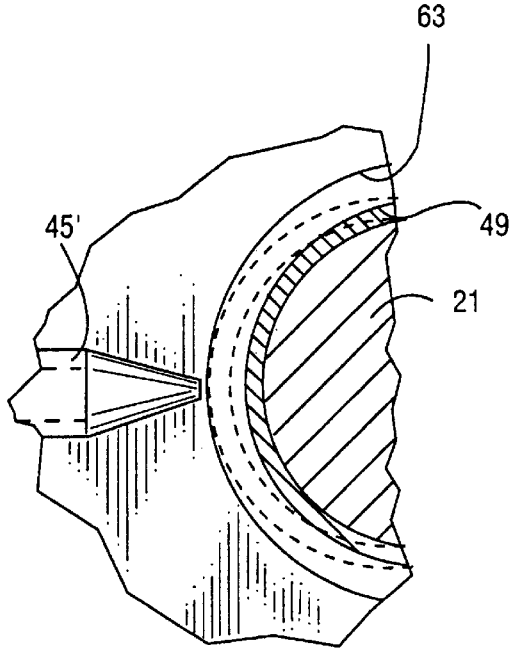
FIG. 7C is a further closeup of FIG. 7A.

The lateral movement sensing elements of the present embodiment of apparatus 11 are shown in greater detail in FIGS. 7A–7C. The sensing elements 45 and 45' are located at 180° phase opposition relative to the elongated striker 21. The elements 45 and 45' are typically placed in a horizontal plane running through the center of striker 21, bisecting axis 65 and parallel to the striking platform 13. The sensing elements 51 and 51' are at 180° phase opposition to one another in a plane perpendicular to the sensor elements 45 and 45'. Thus, the four sensing elements are in 90° phase opposition to one another around the brushing 49 and striker 21.

FIGS. 7B and 7C show how electrical contact is made between the bushing 49 and lateral movement sensing element 45'. The bushing 49 is shown in solid lines when at a resting position. If the striker 21 is struck in a non-linear fashion to cause non-linear movement of the striker 21, the striker 21, and hence the bushing 49, moves laterally towards the sensing element 45'. This sensing element is contacted when the strike is at an angle to the right of the user facing the front face 20 of the housing. The bushing 49 when being struck in a non-linear fashion is shown in dotted lines, wherein the bushing 49 formes a complete circuit with the power source 59 and causes the light 23' to alight, thus alerting the user to the non-linear strike, and the direction the strike was made.

Figure 8:
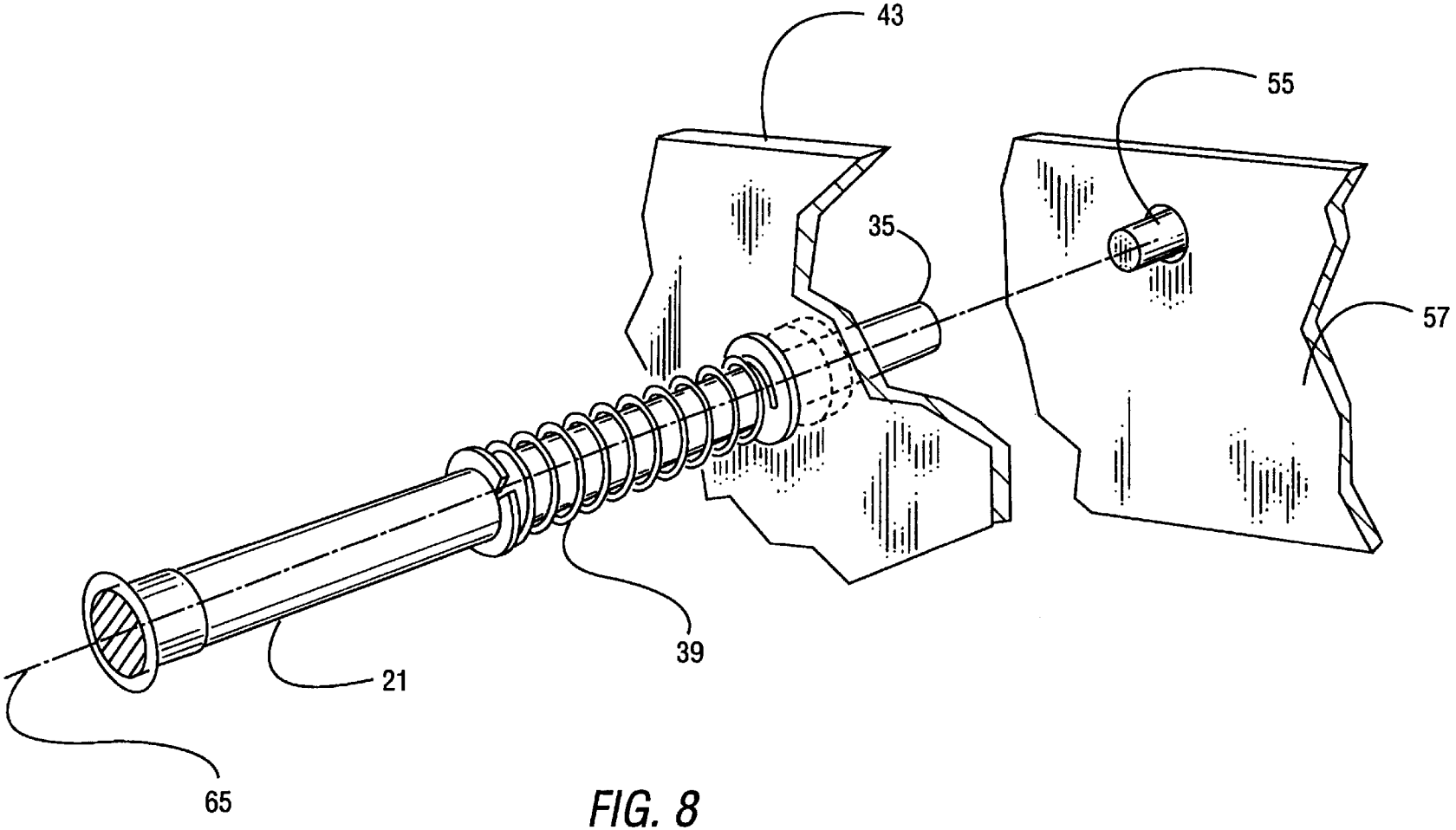
FIG. 8 is a perspective view of the elongated striker of the invention within the housing.

FIG. 8 shows the operation of the push switch 55 in greater detail. The biasing spring 39 maintains the striker 21 in a position away from the push switch, towards the front face. Once the elongated striker 21 is struck by a user, the force of the strike pushes the striker 21 away from the user and front face and towards the support element 57. The push switch 55 is kept in the same axis 65 as the striker so that the terminal end 35 of the striker 21 hits the push switch 55 when adequate force is applied to the striking end 33 of the striker 21. Engaging the push switch causes a light, in the present embodiment lights 29 and 29', to alight.

Figure 9:
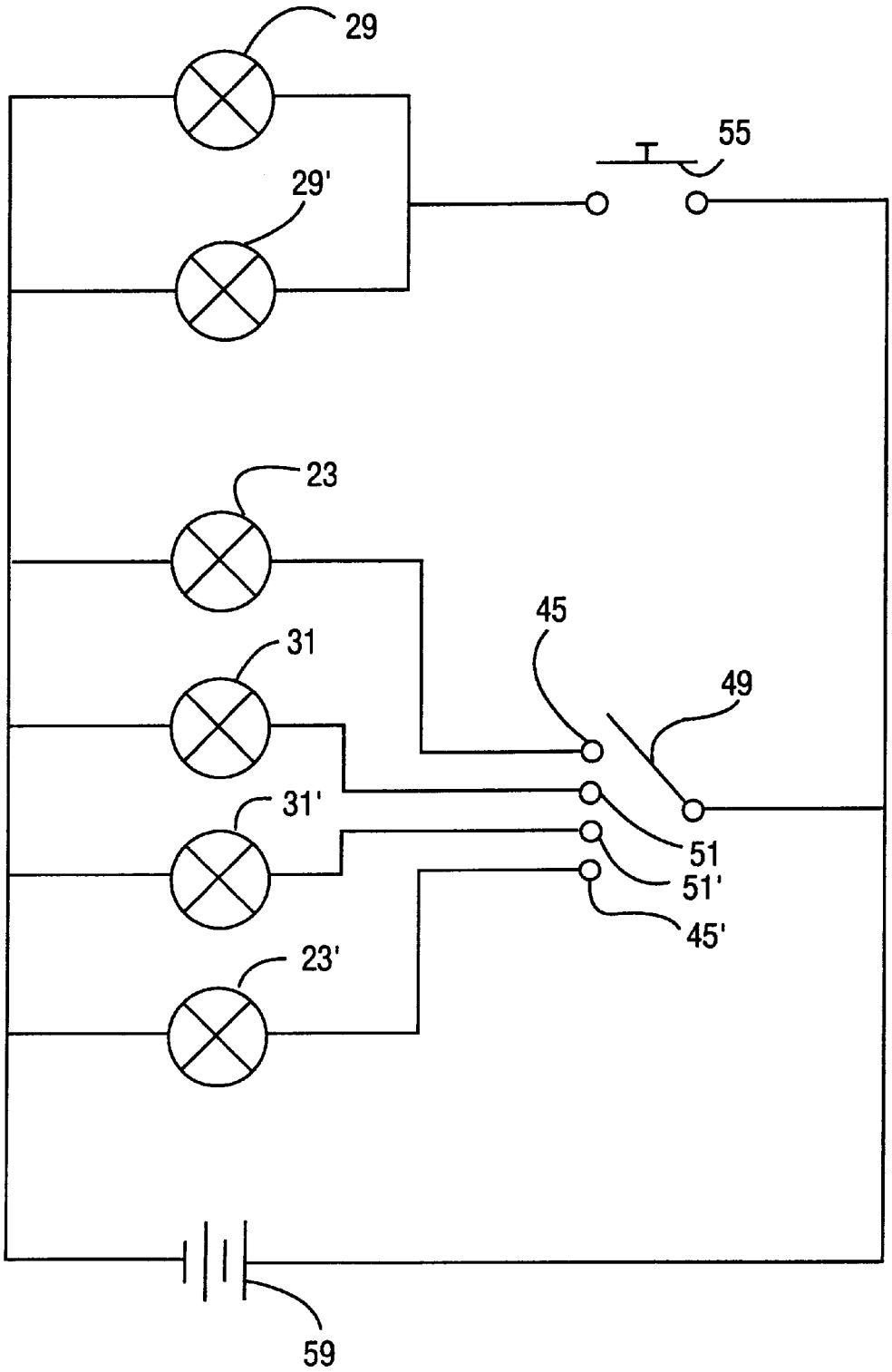
FIG. 9 is a schematic of the electrical circuitry of the apparatus.

The electrical circuitry of the present embodiment of apparatus 11 is shown in FIG. 9. The visual indicia are connected in parallel with respect to one another. The lateral movement sensing elements 45, 51, 51' and 45' each correspond to lights 23, 31, 31' and 23', respectively. The bushing 49 makes electrical contact with the sensing elements, completing a circuit with the power source 59, which can be either a DC battery or converted AC voltage, and lighting the respective light. Likewise, push switch 55 can be engaged to complete an electrical circuit with the power source to alight lights 29 and 29'.

Use of Apparatus

Figure 12:
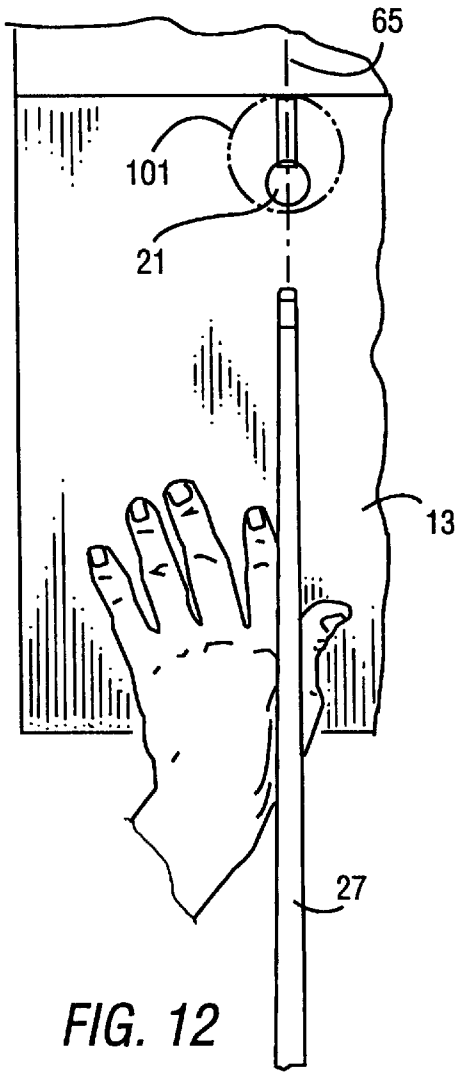
FIG. 12 is a view from above of a user training on the apparatus.
Figure 11:
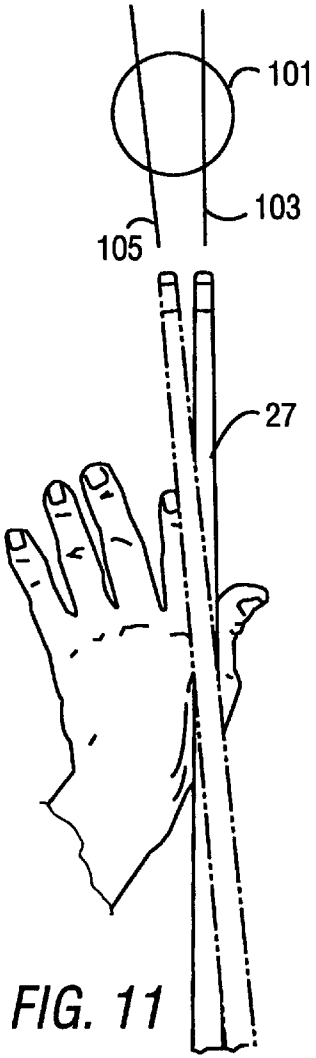
FIG. 11 is a view from above of a user holding a cue.
Figure 10:
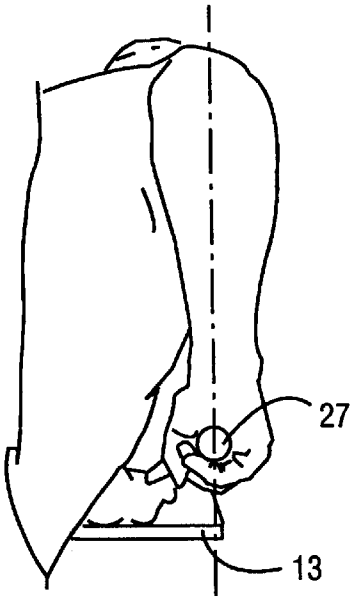
FIG. 10 is a view from behind of a user training on the apparatus.

The use of the apparatus 11 is now described with reference to FIGS. 10–12. The user, holding cue 27, stands in front of the apparatus facing the front face of the apparatus 11. The cue is typically held as shown in FIG. 3 and FIGS. 10–12, with one hand resting on the striking platform, the cue resting on the hand. The user then aims the end of the cue 27 at a cue ball 101. Either angle 103 or 105 would cause a non-linear strike against the cue ball which would be detected by the apparatus 11. Hence, FIG. 12 shows an in-line striking position of the cue 27 and elongated striker 21, the cue aligned with the axis 65. A strike in this axis should result in no lateral movement of the elongated striker, hence, no lights alighting on the front face except for lights 29 and 29' indicating a hit with enough force to engage the push switch.

The use of the apparatus 11 offers many advantages. First, it can be used alone so that a potential billiards player may practice on her own without setting up all the balls, and re-setting them up after each hit on an actual table. Further, it may be difficult to tell when the cue is not aligned properly as in FIG. 11. The apparatus 11 will alert the user to such non-alignment. Also, the apparatus can be set up in any room to store out of the way in a vertical position as in FIG. 1, and in a working horizontal position as in FIG. 2.

While the invention has been shown in only one of its forms, it is not thus limited but is susceptible to various changes and modifications without departing from the spirit thereof.

What is claimed is:

1. An apparatus for training a user to properly strike a cue ball, the apparatus comprising:

an elongated striker held in a horizontal position by at least one support element;

a simulated target ball attached to one end of said elongated striker;

at least one lateral movement sensing element; and wherein the elongated striker is positioned to be struck in-line by a cue, the lateral movement sensing element alerting the user to any non-linear movement of the cue relative to the striker.

2. The apparatus of claim 1, wherein the elongated striker is held within the at least one support element by a biasing spring, the spring maintaining a positive pressure on the striker as it is being struck by a user.

3. The apparatus of claim 1, wherein sensitivity of the at least one lateral movement sensing element is adjustable.

4. The apparatus of claim 1, wherein the elongated striker has a striking end and a terminal end.

5. The apparatus of claim 1, further comprising a push switch which is engaged by the terminal end of the elongated striker upon being struck with an adequate force by the cue of the user.

6. The apparatus of claim 4, wherein the striking end of the elongated striker extends from a housing.

7. The apparatus of claim 6, wherein the housing has a means for allowing vertical wall mounting and extension to a horizontal position when in use.

8. The apparatus of claim 6, wherein the at least one lateral movement sensing element is coupled to visual indicia elements located exterior of the housing, the indicia elements being activated upon a non-linear strike of the elongated striker.

9. The apparatus of claim 1, wherein there are two lateral movement sensing elements, each placed in 180° phase opposition to one another relative to the elongated striker.

10. The apparatus of claim 1, wherein there are four lateral movement sensing elements, each placed in 90° phase opposition to one another relative to the elongated striker.

11. The apparatus of claim 9, wherein the two lateral movement sensing elements are placed in a horizontal plane coextensive with the elongated striker.

12. The apparatus of claim 1, further comprising a power source, the power source being either a battery or converted AC voltage.

13. An apparatus for training a user to properly strike a cue ball, the apparatus comprising:

a housing having a front face, the housing coupled to a striking platform extending a length from the housing;

an elongated striker held in position by at least one support element, the elongated striker having a striking end and a terminal end;

the striking end extending out from the front face of the housing positioned parallel to the striking platform;

a simulated target ball attached to one end of said elongated striker;

at least one lateral movement sensing element electronically coupled to at least one visual indicia elements;

wherein the elongated striker is positioned to be struck in-line by a cue, the lateral movement sensing element alerting the user to any non-linear movement of the cue relative to the striker.

14. The apparatus of claim 13, wherein the elongated striker is held within the at least one support element by a biasing spring, the spring maintaining a positive pressure on the striker as it is being struck by a user.

15. The apparatus of claim 13, wherein sensitivity of the at least one lateral movement sensing element is adjustable.

16. The apparatus of claim 13, further comprising a push switch which is engaged by the terminal end of the elongated striker upon being struck with an adequate force by the cue of the user.

17. The apparatus of claim 13, wherein the housing has a means for allowing vertical wall mounting and extension to a horizontal position when in use.

18. The apparatus of claim 13, wherein there are two lateral movement sensing elements, each placed in 180° phase opposition to one another relative to the elongated striker.

19. The apparatus of claim 13, wherein there are four lateral movement sensing elements, each placed in 90° phase opposition to one another relative to the elongated striker.

20. The apparatus of claim 19, wherein a visual indicia element is electronically coupled to each lateral movement sensing element, each visual indicia element activating upon electrical contact of the elongated striker with the corresponding sensing element.

21. The apparatus of claim 19, wherein the two lateral movement sensing elements are placed in a horizontal plane coextensive with the elongated striker.

22. The apparatus of claim 13, further comprising a power source, wherein the power source can be either a battery or converted AC voltage.

* * * * *